US007779996B2

(12) United States Patent
Elias et al.

(10) Patent No.: US 7,779,996 B2
(45) Date of Patent: Aug. 24, 2010

(54) BOX WITH A-FRAME PRODUCT SUPPORT

(75) Inventors: Susan M. Elias, St. Paul, MN (US); Julia Hou, Glendale, CA (US); Jessica Chorney, Minneapolis, MN (US); Neal Anderson, Edina, MN (US); Michael L. Teitelbaum, New York, NY (US)

(73) Assignee: Target Brands, Inc., Minneapolis, MN (US)

( * ) Notice: Subject to any disclaimer, the term of this patent is extended or adjusted under 35 U.S.C. 154(b) by 36 days.

(21) Appl. No.: 12/130,836

(22) Filed: May 30, 2008

(65) Prior Publication Data

US 2009/0272658 A1 Nov. 5, 2009

Related U.S. Application Data

(60) Provisional application No. 61/049,306, filed on Apr. 30, 2008.

(51) Int. Cl.
*B65D 5/52* (2006.01)
*B65D 25/24* (2006.01)

(52) U.S. Cl. ..... 206/45.23; 206/6.1; 206/45.2; 206/736; 206/566

(58) Field of Classification Search ..... 206/45.23, 206/45.29, 6.1, 205, 301, 553, 566, 736–774, 206/45.21, 45.28, 45.2, 45.24, 45.25, 6.01
See application file for complete search history.

(56) References Cited

U.S. PATENT DOCUMENTS 476,765 A 6/1892 Knapp
993,330 A 5/1911 Walker
1,272,618 A 7/1918 Burgess
1,279,618 A * 9/1918 Burgess ..... 314/91
1,411,678 A 4/1922 Walker
1,520,135 A 12/1924 Myers
1,536,949 A 5/1925 Tinsley
1,563,148 A * 11/1925 Bartol, Jr. et al. ..... 206/732
1,616,708 A * 2/1927 Tanner ..... 206/45.29
1,743,502 A * 1/1930 Tanner ..... 206/45.29
1,944,714 A 1/1934 Lehmann
2,024,091 A 12/1935 Colgate
2,024,702 A 12/1935 Powell
2,248,547 A 7/1941 Osteen (Continued)

*Primary Examiner*—Mickey Yu
*Assistant Examiner*—Chun Cheung
(74) *Attorney, Agent, or Firm*—Nixon & Vanderhye P.C.

(57) ABSTRACT

A container includes a housing having an open top and a lid attached to the housing. The lid includes a first panel having a first edge and a second edge, a second panel having a first edge and a second edge, and a third panel. The first edge of the first panel is attached to the housing at a first hinge. The first edge of the second panel is attached to the second edge of the first panel at a second hinge. The third panel is attached to the second edge of the second panel at a third hinge. The lid is positionable in a first position and a second position. When the lid is in the first position, the lid covers the open top of the housing and the first hinge and the third hinge form a virtual hinge. When the lid is in the second position, the lid forms an A-Frame over the open top such that the second panel forms a display platform. The third panel maintains the lid in the second position.

22 Claims, 8 Drawing Sheets

U.S. PATENT DOCUMENTS

| | | | | |
|---|---|---|---|---|
| 2,414,671 | A | 1/1947 | Rosenthal | |
| 2,585,361 | A | 2/1952 | Williamson | |
| 2,649,195 | A | 8/1953 | Rossi et al. | |
| 2,684,757 | A | 7/1954 | McCarthy | |
| 2,695,097 | A | 11/1954 | Easton | |
| 4,034,849 | A | 7/1977 | Zakrajsek | |
| 4,750,612 | A | 6/1988 | Schuster | |
| 4,767,000 | A | 8/1988 | Ovadia et al. | |
| 5,325,960 | A | 7/1994 | Sims | |
| 5,927,487 | A | 7/1999 | Whittle et al. | |
| 6,352,151 | B1 | 3/2002 | Stewart | |
| 6,758,330 | B1 | 7/2004 | Chudada | |
| 7,066,380 | B2 * | 6/2006 | Blake | 229/122.1 |
| 7,178,778 | B2 * | 2/2007 | Lee | 248/459 |
| 2007/0007166 | A1 | 1/2007 | Bucalo | |

* cited by examiner

BOX WITH A-FRAME PRODUCT SUPPORT

CROSS-REFERENCE TO RELATED APPLICATIONS

This application claims priority under 35 U.S.C. §119(e) to U.S. Provisional Application No. 61/049,306, filed Apr. 30, 2008, entitled "Box with A-Frame Product Support," which is incorporated herein by reference in its entirety.

BACKGROUND

Various types of boxes or other containers are available for storing and displaying small articles and products, such as jewelry. The boxes may be used in a home for personal use or in the retail environment for commercial use. The box stores the product when the product is not being displayed to protect it from damage. The product may also be displayed using the box as a display platform to provide a more pleasing presentation of the product. This is particularly true in a retail environment. When purchasing an item, a product seems more desirable to the consumer when it is displayed in an aesthetically pleasing manner. To provide a more visually pleasing display, the box may be converted to a display platform on which to show or exhibit the product. The box thus serves two functions, as a protective housing when the product is being stored and as an aesthetically pleasing display when the product is being shown. While several convertible boxes are currently available, room for improvement remains.

SUMMARY

Some aspects relate to a container having a housing with an open top and a lid attached to the housing. The lid includes a first panel having a first edge and a second edge, a second panel having a first edge and a second edge, and a third panel. The first edge of the first panel is attached to the housing at a first hinge. The first edge of the second panel is attached to the second edge of the first panel at a second hinge. The third panel is attached to the second edge of the second panel at a third hinge. The lid is positionable in a first position and a second position. When the lid is in the first position, the lid covers the open top of the housing and the first hinge and the third hinge form a virtual hinge. When the lid is in the second position, the lid forms an A-Frame over the open top such that the second panel forms a display platform. The third panel maintains the lid in the second position.

Some aspects relate to a box for storing and displaying a small article. The box includes a base and a cover. The base has a bottom panel, a first substantially vertical wall, a second substantially vertical wall opposite the first substantially vertical wall, a third substantially vertical wall and a fourth substantially vertical wall opposite the third substantially vertical wall. The substantially vertical walls extend substantially perpendicularly from the bottom panel. The cover is attached to one of the substantially vertical walls of the base and includes a front panel attached to the base at a first hinge, a rear panel attached to the front panel at a second hinge, and a flap attached to the rear panel at a third hinge. The flap maintains the cover in a display position relative to the base. The first vertical wall of the base and the flap each includes a magnetic component that interact to maintain the cover in the display position.

Some aspects relate to a method of displaying a product by first pivoting a cover to which the product is secured about a hinge away from a front wall of a box. The cover has an attachment section, an intermediate section and an end section. The method further includes extending the intermediate section from the attachment section, extending the end section from the intermediate section, bending the intermediate section towards the attachment section to form an acute angle between a bottom surface of the intermediate section and a bottom surface of the attachment section, and positioning the end section parallel to the front wall of the box such that a connection component of the end section interacts with a complementary connection component of the front wall to maintain the bottom surface of the attachment section and the bottom surface of the intermediate section at an acute angle relative to one another. The method also includes displaying the product on the intermediate section to a viewer.

Some aspects relate to a display platform including a structure, a top and a means for maintaining the display platform in a display position. The structure includes a base piece, first side piece, a second side piece, a third side piece and a fourth side piece. The side pieces are attached to the base piece. The top is attached to one of the side pieces of the structure and includes an attachment segment attached to one of the side pieces, an intermediate segment attached to the attachment segment at a second hinge, and an end segment attached to the intermediate segment at a third hinge. The end segment maintains the cover in the display position and is substantially equal in size to the side pieces.

Various other aspects are contemplated and should be understood with reference to the text and drawings that follow.

Figure 1:
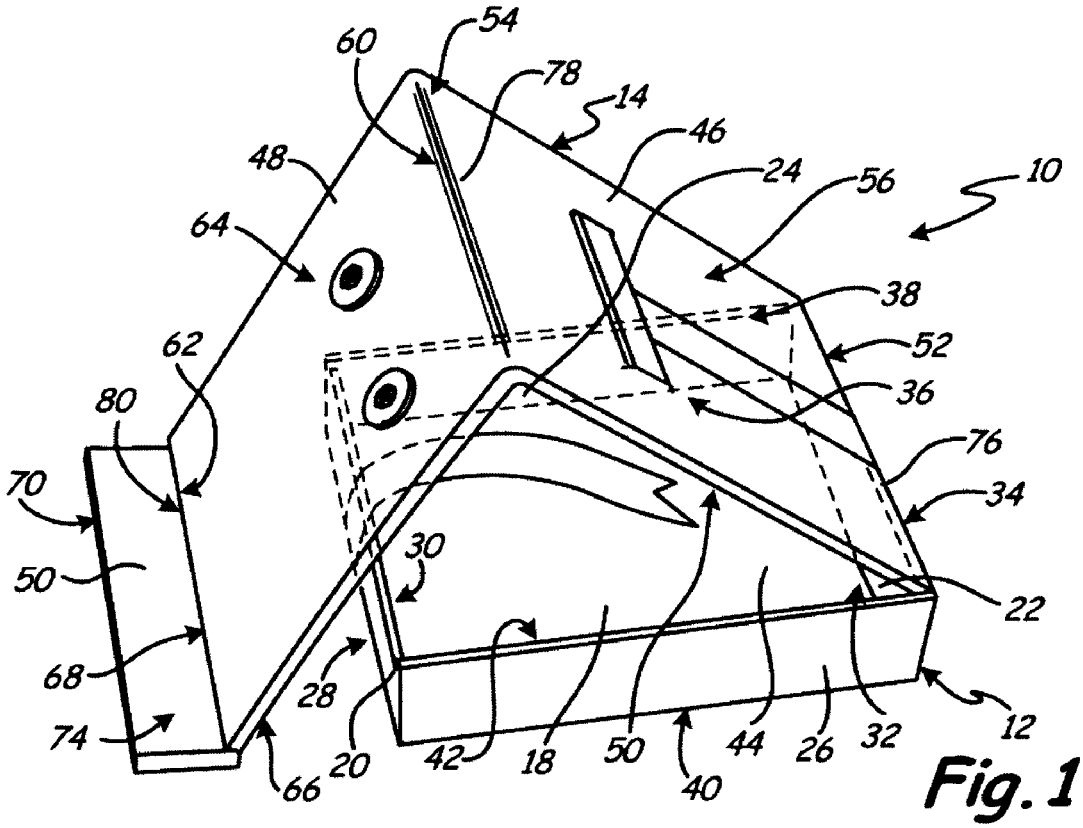
FIG. 1 is perspective view of a storage and display system, according to some embodiments.

While the invention is amenable to various modifications and alternative forms, some embodiments have been shown by way of example in the drawings and are described in detail below. As alluded to above, the intention, however, is not to limit the invention by those examples. On the contrary, the invention is intended to cover all modifications, equivalents, and alternatives.

DETAILED DESCRIPTION

FIG. 1 shows a perspective view of a storage and display box 10, according to some embodiments. The box 10 includes a base 12 and a cover 14 connected to the base 12. The box 10 is able to be transitioned to a storage position (shown in FIG. 2), an open position (shown in FIG. 3) and a display position (shown in FIG. 5). A product 16 (e.g., earrings or a necklace) is secured to the cover 14 of the box 10. When the box 10 is in the storage position, the cover 14 extends over the base 12, for example, to protect and/or conceal the product 16, such as a piece of jewelry. As will be described in greater detail, the cover 14 is then able to be opened, unfolded, and reconfigured to expose the product 16 and provide an angled platform on which the product 16 is displayed. In some other embodiments, the product 16 is positioned in the base 12 (e.g., on padding), the cover 14 is unfolded and reconfigured for display, and the product 16 is removed from the base 12 and is secured to the cover 14.

The box 10 may be used for product storage and display in a number of environments, including, but not limited to, home environments and retail environments. In addition, although some examples of the product 16 are discussed as being earrings, for example, any of a variety of articles or products may be stored and displayed using the box 10, including articles of a variety of types and sizes. For example, the box 10 is optionally adapted or otherwise sized and shaped to house clothing items, toys, or other articles or accessories.

The base 12, also described as a housing or a structure, includes a bottom panel 18, a front vertical wall 20, a rear vertical wall 22, a first vertical side wall 24 (shown in phantom) and a second vertical side wall 26. The front vertical wall 20 includes a bottom edge 28 and a top edge 30, the rear vertical wall 22 includes a bottom edge 32 and a top edge 34, the first vertical side wall 24 includes a bottom edge 36 and a top edge 38, and the second vertical side wall 26 includes a bottom edge 40 and a top edge 42. The bottom edges 28, 32, 36, 40 of the vertical walls 20, 22, 24, 26, respectively, are attached to the bottom panel 18 such that they extend substantially perpendicularly from the bottom panel 18. Each of the vertical walls 20, 22, 24, 26 is also attached to each adjacent vertical wall 20, 22, 24, 26 at a substantially ninety degree angle to form a rectangular shape. When the vertical walls 20, 22, 24, 26 are attached to the bottom panel 18 and to each other, the top edge 30 of the front vertical wall 20 sits below the top edges 34, 38, 42 of the other vertical walls 22, 24, 26 to form a notch 27 along the top edges 30, 34, 38, 42 of the base 12.

In some embodiments, the bottom panel 18 is about 4 inches long and about 3.5 inches wide, although other dimensions are contemplated. The front vertical wall 20 is about 4 inches long and about 0.9 inches high, although other dimensions are contemplated. The rear vertical wall 22 is about 3.5 inches long and about 1 inch high, although other dimensions are contemplated. Each of the first and second vertical side walls 24, 26 is about 4 inches long and about 1 inch high, although other dimensions are contemplated. In some embodiments, the base 12 is optionally formed of cardboard, wood, plastic, metal, or other suitable material.

If desired, the base 12 also includes an optional padding 44 (shown in broken lines in FIG. 1A) housed between the vertical walls 20, 22, 24, 26 to protect the product 16 from damage when the box 10 is being transported from location to location or to serve one or more additional or alternate purposes. For example, in addition to providing protection to the product 16, the padding 44 also optionally provides a decorative or aesthetically pleasing base 12 on which to store the product 16 if desired. Although FIG. 1 depicts the base 12 as being substantially rectangular in shape, the base 12 optionally takes any of a variety of shapes.

The cover 14, also described as a lid or a top, is partitioned into three hingedly attached sections, a first attachment section or panel 46, a second intermediate section or panel 48 and a third end section or panel 50. The first attachment panel 46, also described as a front portion, has a first edge 52, a second edge 54, a top surface 56 and a bottom surface 58; the second intermediate panel 48, also described as a rear portion, has a first edge 60, a second edge 62, a top surface 64 and a bottom surface 66; and the third end panel 50, also described as a flap, has a first edge 68, a second edge 70, a top surface 72 and a bottom surface 74. The first edge 52 of the first attachment panel 46 is attached to the top edge 34 of the rear vertical wall 22 to form a first hinge 76. The second edge 54 of the first attachment panel 46 is attached to the first edge 60 of the second intermediate panel 48 to form a second hinge 78. The second edge 62 of the second intermediate panel 48 is attached to the first edge 68 of the third end panel 50 to form a third hinge 80.

In some embodiments, the bottom panel 18, front vertical wall 20, rear vertical wall 22, first vertical side wall 24 and second vertical side wall 26 of the base are attached to each other by adhesives and the first attachment panel 46, second intermediate panel 48 and third end panel 50 of the cover 14 are attached to each other by first hinge 76, second hinge 78 and third hinge 80 (as shown in FIG. 1).

Figure 1A:
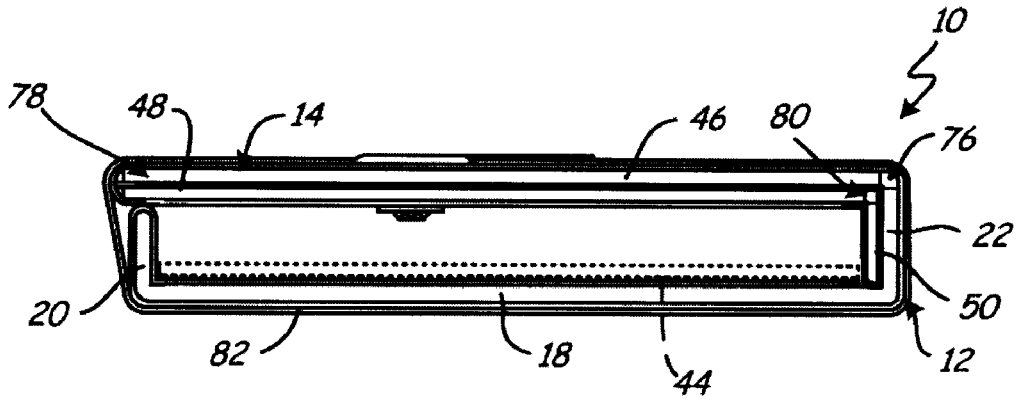
FIG. 1A is a cross-sectional view of a storage and display system, according to some embodiments.

Alternatively, FIG. 1A shows a cross-sectional view of the box 10 in which at least portions of the base 12 and the cover 14 are attached to each other by a covering 82. In some embodiments, the covering 82 is positioned over each of the bottom panel 18, front vertical wall 20, rear vertical wall 22, first vertical side wall 24 (shown in FIG. 1) and second vertical side wall 26 of the base and the first attachment panel 46, second intermediate panel 48 and third end panel 50 of the cover 14. In particular, the covering 82 functions both as a decorative feature of the box 10 as well as the first hinge 76 between the rear vertical wall 22 and the first attachment panel 46, the second hinge 78 between the first attachment panel 46 and the second intermediate panel 48 and the third hinge 80 between the second attachment panel 48 and the third end panel 50. When the covering 82 is used to attach the panels 46, 48, 50 of the cover 14 to the base 12, a sufficient amount of room is left between the rear vertical wall 22 of the base 12 and the first attachment panel 46 as well as between each of the panels 46, 48, 50 so that the rear vertical wall 22 and the first attachment panel 46 and the panels 46, 48, 50 have room to fold with respect to one another. Because the covering 82 holds the pieces together, the covering 82 also functions as the hinges 76, 78, 80 between the adjacent pieces.

The first attachment panel 46 is substantially the same length but is slightly more narrow than the bottom panel 18 so that the first attachment panel 46 fits within the top edges 38, 42 of the first and second vertical side walls 24, 26, respectively. The second intermediate panel 48 is substantially the same width but slightly shorter than the first attachment panel 46 so that the second intermediate panel 48 fits within the vertical walls 20, 22, 24, 26 of the base 12 when the box 10 is in the storage position. The third end panel 50 is slightly more narrow and slightly shorter than the rear vertical wall 22 so that the third end panel 50 fits between the first and second vertical side walls 24, 26 but does not extend past the top edges 34, 38, 42. In some embodiments, the first attachment panel 46 is about 4 inches long and about 3.4 inches wide, the second intermediate panel 48 is about 3.9 inches long and about 3.4 inches wide, and the third end panel 50 is about 3.4 inches long and about 0.9 inches high, although other dimensions are contemplated. The cover 14 is optionally formed of cardboard, wood, plastic, metal, or other suitable material.

Figure 2:
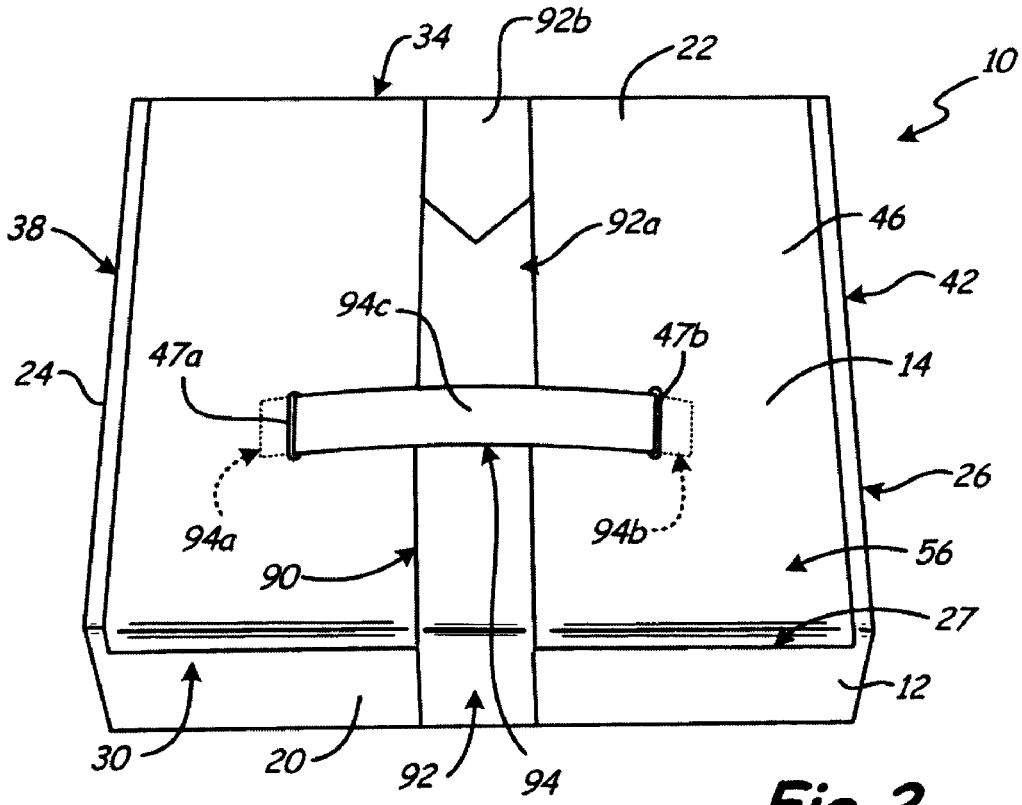
FIG. 2 is a perspective view of the storage and display system of FIG. 1 in a storage position, according to some embodiments.
Figure 2A:
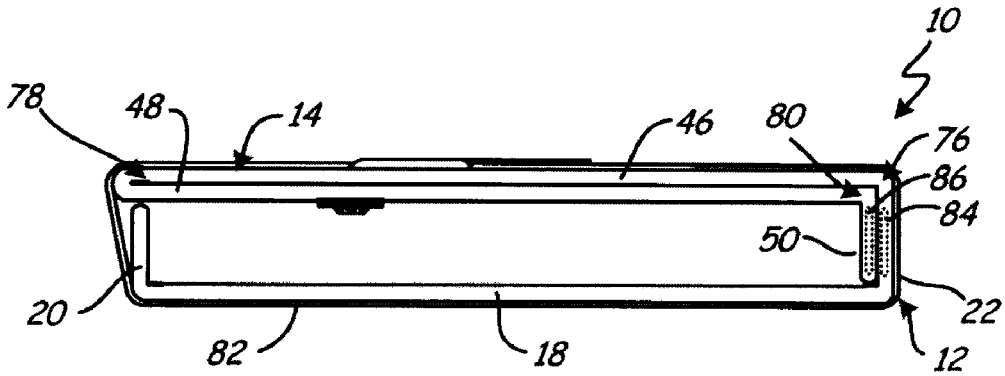
FIG. 2A is a cross-sectional view of the storage and display system of FIG. 1 in a storage position, according to some embodiments.
Figure 3:
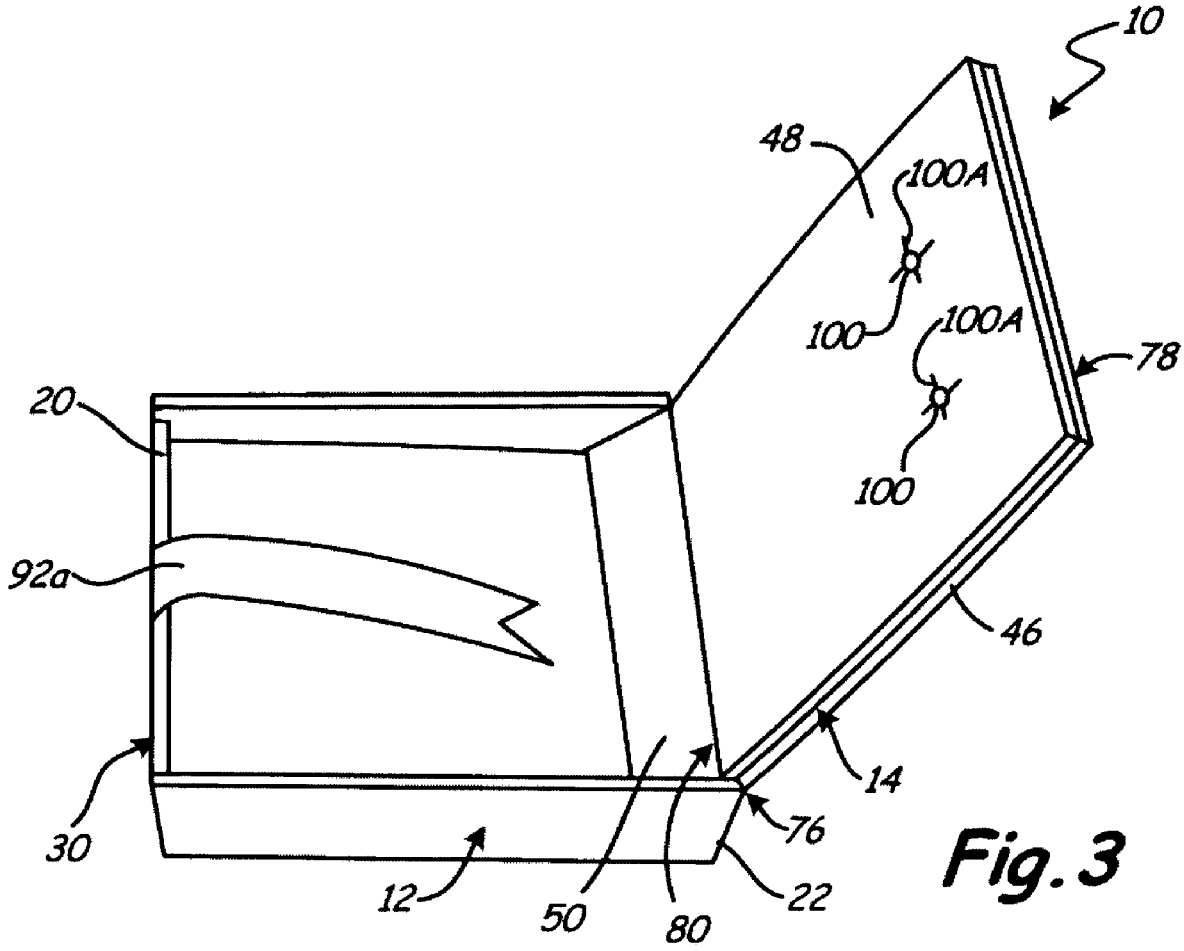
FIG. 3 is a perspective view of the storage and display system of FIG. 1 in an open position, according to some embodiments.

FIG. 2 shows a perspective view of the box 10 in a storage (or closed) position and FIG. 2A shows a cross-sectional view of the box 10 in the storage position, according to some embodiments. As can be seen in FIGS. 2 and 2A, when the box 10 is in the storage position, the cover 14 overlaps the base 12 such that the box 10 has a closed interior. When the box 10 is in the storage position, the bottom surface 66 of the second intermediate panel 48 (shown in FIG. 1) is substantially parallel and flush with the bottom surface 58 (shown in FIG. 1) of the first attachment panel 46. Together, the first attachment and second intermediate panels 46, 48 are pivoted about the first hinge 76 toward the front vertical wall 20 until the first attachment and the second intermediate panels 46, 48 lie on the top edge 30 of the front vertical wall 20 within the notch 27 between the top edges 38, 42 of the vertical side walls 24, 26 of the base 12. In some embodiments, the notch 27 has a height substantially equal to a thickness of the first attachment and the second intermediate panels 46, 48 so that when the box 10 is in the storage position, the top surface 56 of the first attachment panel 46 lies substantially in the same plane as the top edge 34 of the rear vertical wall 22 and the top edges 38, 42 of the vertical side walls 24, 26. Optionally, when the box 10 is in the storage position, the second hinge 78 between the first attachment panel 46 and the second intermediate panel 48 extends slightly past the front vertical wall 20 (e.g., by about 0.125 inches) such that the cover 14 is easily lifted from the notch 27 away from the base 12 to transition the box 10 from the storage position to the open position (FIG. 3).

Referring now in particular to FIG. 2A, in some embodiments, the rear vertical wall 22 includes a magnetic component 84 and the third end panel 50 includes a magnetic component 86. In some embodiments, the magnetic components 84, 86 are secured in place using an adhesive sheet or label. The magnetic components 84, 86 form a complementary connection means, such as a magnet-magnet or magnet-ferrous material connection. Thus, as the third end panel 50 is brought in closer proximity to the rear vertical wall 22, the magnetic components 84, 86 interact with each other and draw the third end panel 50 toward the rear vertical wall 22. As can be seen in FIGS. 2 and 2A, when the first attachment panel 46 and the second intermediate panel 48 are folded about the first hinge 76, the third end panel 50 is naturally positioned flush against the back vertical wall 22 such that the third hinge 80 between the second intermediate panel 48 and the third panel 50 is aligned with the first hinge 76. In this position, the first hinge 76 and the third hinge 80 form a virtual hinge 88 between the base 12 and the cover 14 about which the cover 14 swings or pivots relative to the base 12. When the third end panel 50 is flush against the rear vertical wall 22, the third end panel 50 is maintained in an upright position and acts as a support to the virtual hinge 88 formed by the first hinge 76 and the third hinge 80.

Although FIG. 2A depicts each of magnetic components 84, 86 as being a single rectangular piece that stretches the lengths of the rear vertical wall 22 and the third end panel 50, the magnetic components are optionally any shape and include any number of pieces. In addition, although FIG. 2A depicts the rear vertical wall 22 and the third end panel 50 as including complementary magnetic components 84, 86, any connection components are optionally used to maintain the third end panel 50 to the rear vertical wall 22. For example, the third end panel 50 is held against the rear vertical wall 22 by connection means including, but not limited to: hook and loop fasteners such as those sold under the tradename Velcro®; a tab-and-slot mechanism; a releasable adhesive; a clip; slots; frictional engagement; or a resilient but deformable hinging.

The box 10 also optionally includes a securement means 90 including a tab 92 and a loop 94 for maintaining the box 10 in the storage position. The tab 92 includes a free end 92*a* and a body portion 92*b* attached to the bottom panel 18, the rear vertical wall 22 and part of the first attachment panel 46, for example using an adhesive. The loop 94 includes a first end 94*a*, a second end 94*b* (each shown in dotted lines in FIG. 2) and a body portion 94*c* and is attached to the first attachment panel 46. The loop 94 is attached to the first attachment panel 46 by inserting the first and second ends 94*a*, 94*b* of the loop 94 into respective first and second slots 47*a*, 47*b* cut into the top surface 56 of the first attachment panel 46. As shown in FIG. 2, the first and second ends 94*a*, 94*b* of the loop 94 are inserted a distance through the first and second slots 47*a*, 47*b* such that there is sufficient space to insert the tab 92 between the top surface 56 of the first attachment panel 46 and the body portion 94*c* of the loop 94. The first and second ends 94*a*, 94*b* of the loop 94 extend behind the first attachment panel 46 and are secured in position against a back surface (not shown-) of the first attachment panel 46 using an adhesive sheet (not shown) or label adhered over the first and second ends 94*a*, 94*b* and to the back surface of the first attachment panel 46, although the first and second ends 94*a*, 94*b* are optionally secured to the first attachment panel 46 by any of a variety of means as desired.

Once the cover 14 is positioned over the base 12, the free end 92*a* of the tab 92 is slipped between the top surface 56 of the first attachment panel 46 and the loop 94 to secure the box 10 in the storage position. The free end 92*a* of the tab 92 is pulled through the loop 94 such that the free end 92*a* is aligned with and overlaps the body portion 92*b*. In this position, the tab 92 and loop 94 help prevent the cover 14 from lifting from the notch 27 of the base 12. In some embodiments, the tab 92 and the loop 94 present an attractive, finished look for retailing the box 10 as a gift box to be presented by a purchaser to a third party.

The box 10 also optionally includes additional means for maintaining the free end 92*a* of the tab 92 in alignment with the body 92*b* of the tab 92 and to the top surface 56 of the first attachment panel 46 when the box 10 is in the storage position. As alluded to above, in addition to securing the cover 14 to the base 12, the tab 92 and the loop 94 also optionally add a decorative feature to the box 10. The loop 94 further optionally includes indicia, which is optionally used for marketing purposes, for example, by placing the name of a company on the box 10. Although FIG. 2 depicts the securement means 90 as including the tab 92 and the loop 94, the securement means 90 is optionally any mechanism that is capable of releasably securing the cover 14 to the base 12.

FIG. 3 shows a perspective view of the box 10 in an open position, according to some embodiments. As shown in FIG. 3, the product 16 is optionally maintained on the second intermediate panel 48 using a plurality of apertures 100 for receiving and securing the product 16 to the second intermediate panel 48. In some embodiments, the apertures 100 include die cut slits 100A to provide greater flexibility in the size and type of product received through the apertures 100. For example, an earring post (not shown) is optionally inserted through one of the apertures 100 with a complementary earring backing retaining the earring in the aperture 100. Although FIG. 3 depicts the second intermediate panel 48 as including apertures 100, any attachment means is optionally used to maintain the product 16 to the second intermediate panel 48. For example, other attachment means for maintaining a product to the second intermediate panel 48 include, but are not limited to, hooks, magnets, adhesives, hook and loop fasteners, and others.

When a user desires to expose the product 16 (shown in FIG. 1) for display or remove the product 16 from the box 10, the box 10 is moved from the storage position (shown in FIG. 2) to the open position. To move the cover 14 to the open position, the free end 92*a* of the tab 92 is first released from the loop 94 (shown in FIG. 2).

The first attachment panel 46 and the second intermediate panel 48 are then folded about the first hinge 76 between the rear vertical wall 22 and the first attachment panel 46 away from the top edge 30 of the front vertical wall 20. As can be seen in FIGS. 3 and 3A, as the first attachment panel 46 and the second intermediate panel 48 are folded about the first hinge 76, the third end panel 50 is naturally positioned flush against the back vertical wall such that the third hinge 80 between the second intermediate panel 48 and the third panel 50 is aligned with the first hinge 76. In this position, the first hinge 76 and the third hinge 80 form the virtual hinge 88 between the base 12 and the cover 14.

Figure 4:
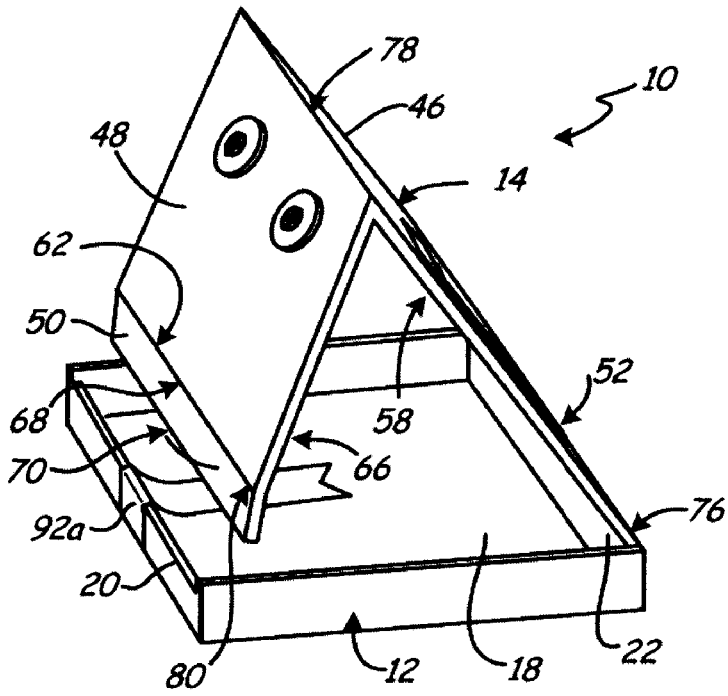
FIG. 4 is a perspective view of the storage and display system of FIG. 1 in an intermediate position, according to some embodiments.
Figure 4A:
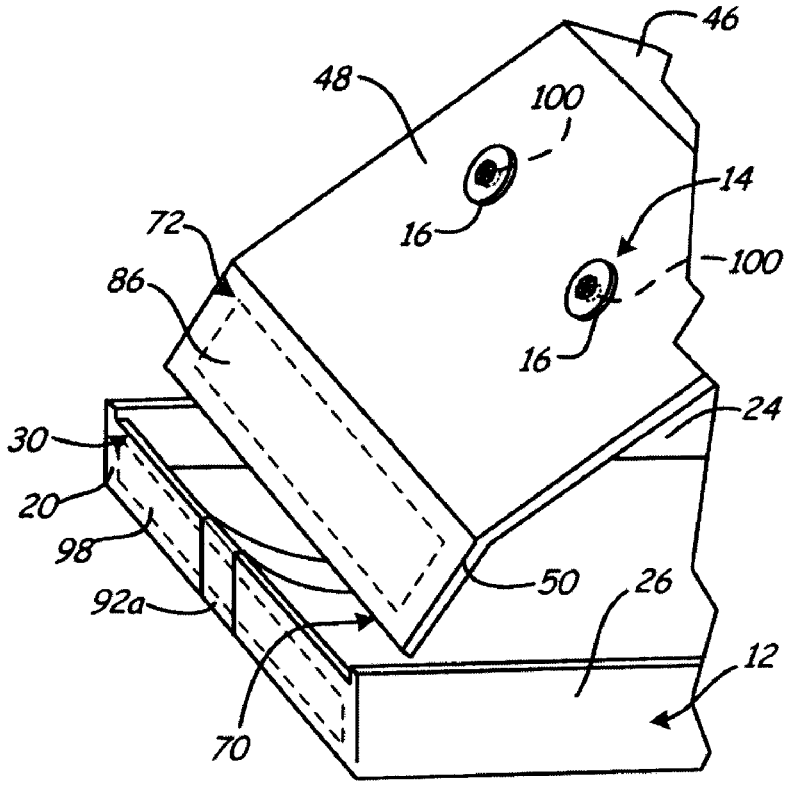
FIG. 4A is an enlarged partial perspective view of the storage and display system of FIG. 1 in an intermediate position, according to some embodiments.

FIG. 4 shows a perspective view of the box 10 in an intermediate position, according to some embodiments. After the first attachment panel 46 and the second intermediate panel 48 have been folded back from the front vertical wall 20 to the open position (shown in FIGS. 3 and 3A), the second intermediate panel 48 is pivoted about the second hinge 78 between the first attachment panel 46 and the second intermediate panel 48 such that the second edge 62 and the bottom surface 66 of the second intermediate panel 48 are pivoted away from the first edge 52 and the bottom surface 58 of the first attachment panel 46. In the second intermediate position, the bottom surface 58 of the first attachment panel 46 and the bottom surface 66 of the second intermediate panel 48 form an acute angle relative to each other.

The third end panel 50 is then pivoted about the third hinge 80 between the second intermediate panel 48 and the third end panel 50 such that the second edge 70 of the third panel 50 is pivoted away from the second intermediate panel 48 and is substantially perpendicular with the bottom panel 18 of the base 12.

Figure 5:
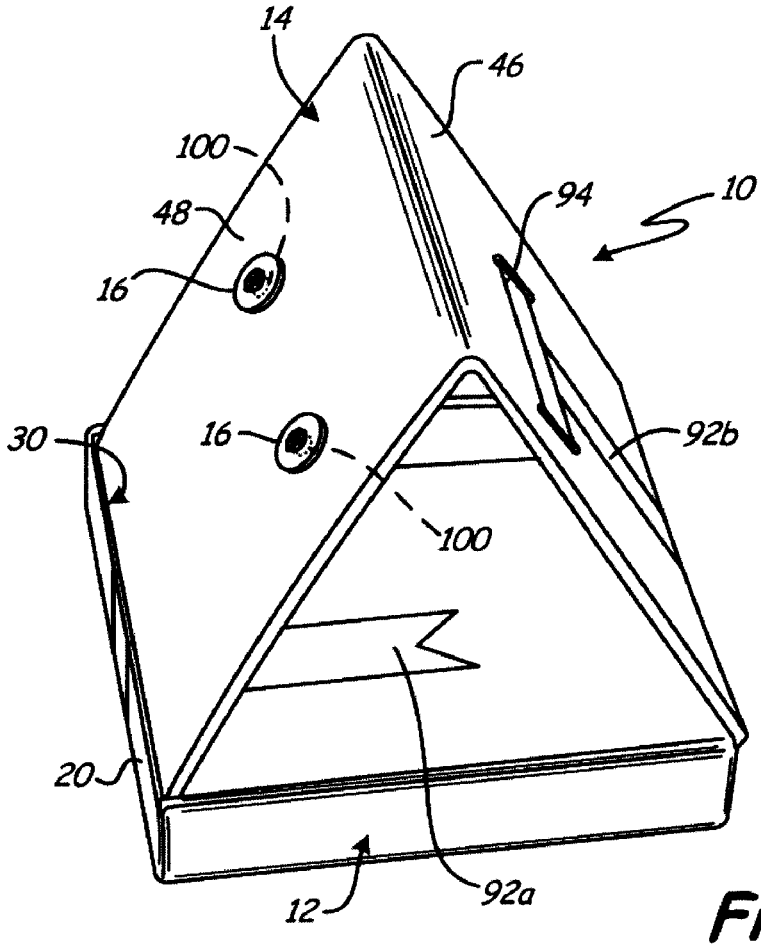
FIG. 5 is a perspective view of the storage and display system of FIG. 1 in a display position, according to some embodiments.
Figure 5A:
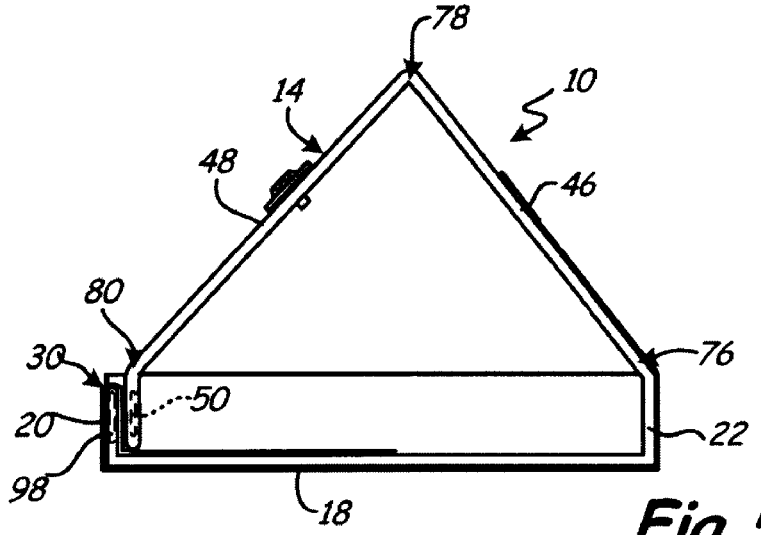
FIG. 5A is a cross-sectional view of the storage and display system of FIG. 1 in the display position, according to some embodiments.
Figure 6:
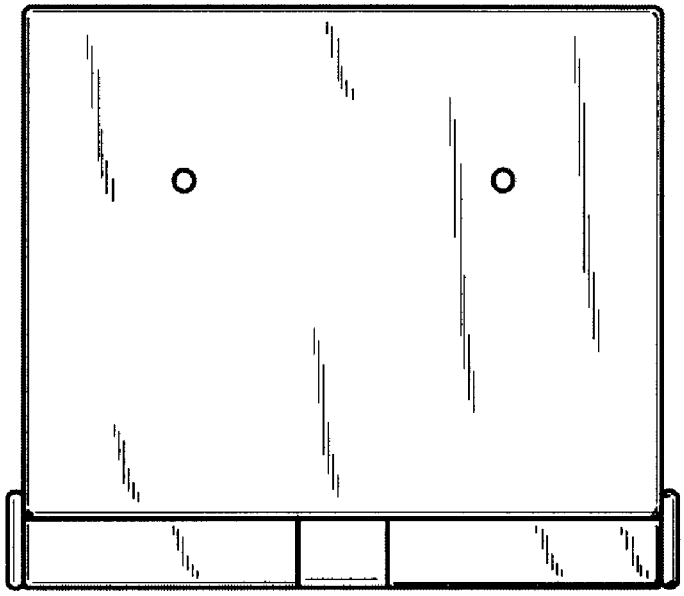
FIG. 6 is a front view of the storage and display system of FIG. 5, according to some embodiments.
Figure 7:
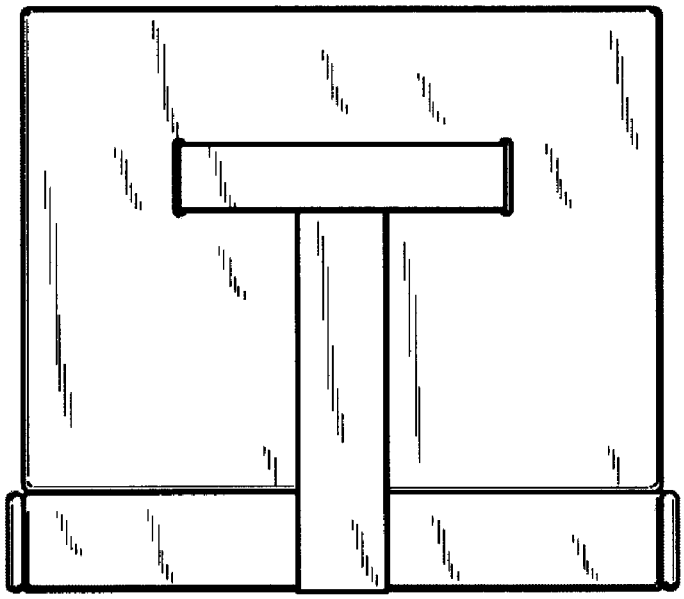
FIG. 7 is a rear view of the storage and display system of FIG. 5, according to some embodiments.
Figure 8:
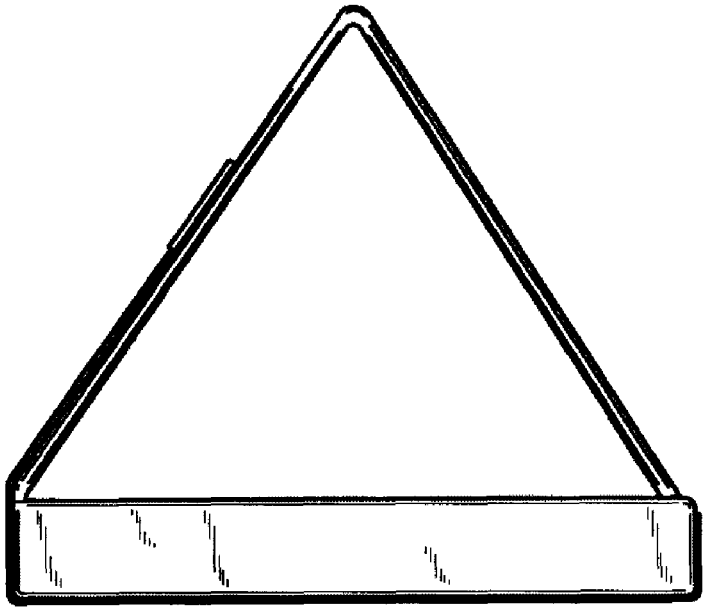
FIG. 8 is a left side view of the storage and display system of FIG. 5, according to some embodiments.
Figure 9:
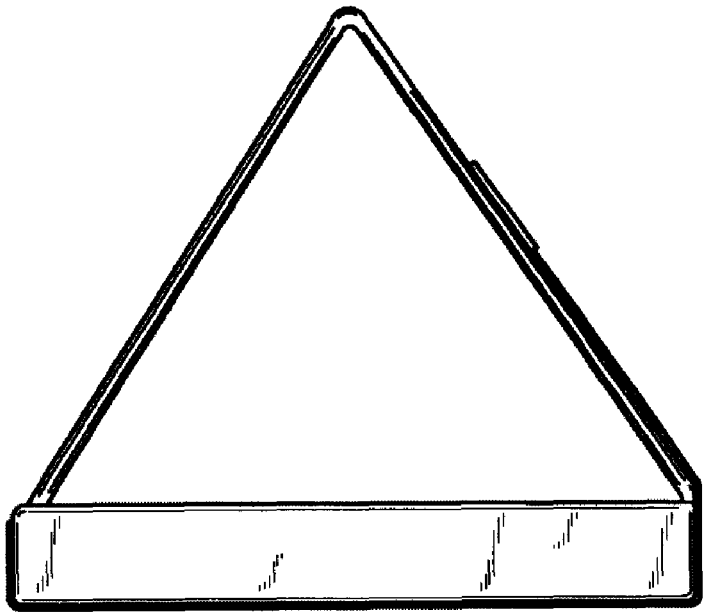
FIG. 9 is a right side view of the storage and display system of FIG. 5, according to some embodiments.
Figure 10:
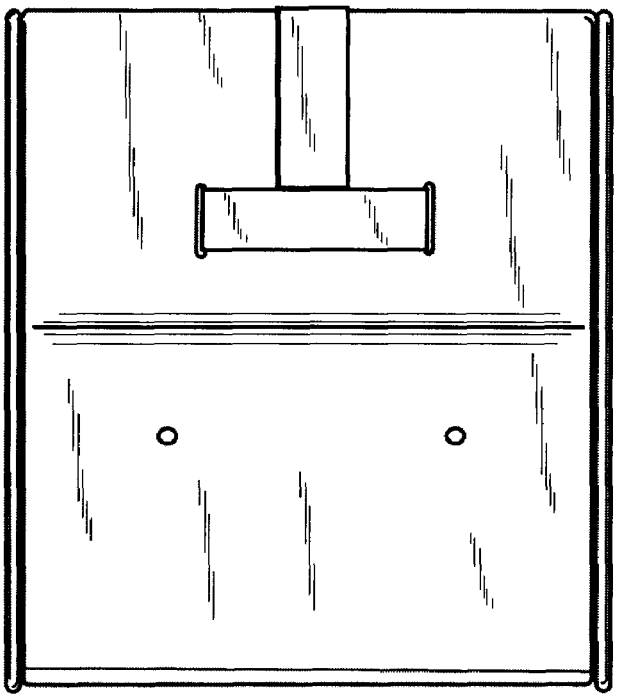
FIG. 10 is a top view of the storage and display system of FIG. 5, according to some embodiments.
Figure 11:
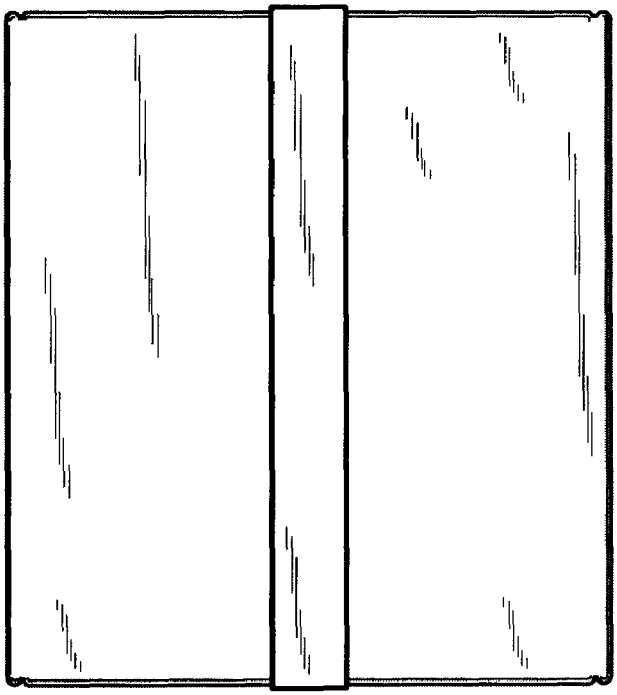
FIG. 11 is a bottom view of the storage and display system of FIG. 5, according to some embodiments.

FIG. 5 shows a perspective view of the box 10 in a display position and FIG. 5A shows a cross-sectional view of the box in the display position, according to some embodiments. From the intermediate position shown in FIG. 4, the third end panel 50 is directed towards the base 12 such that the second edge 70 of the third end panel 50 is facing the bottom panel 18. When the third end panel 50 is guided in this direction, the third end panel 50 is brought within the base 12 such that the top surface 72 of the third end panel 50 is adjacent the first vertical wall 20. In the final display position, the top surface 72 of the third end panel 50 is brought into abutment with the front vertical wall 20. When the top surface 72 of the third end panel 50 is flush with the front vertical wall 20, the first attachment panel 46 and the second intermediate panel 48 are positioned above the base 12 and form an A-frame or an inverted V-shape configuration.

Similar to the rear vertical wall 22 (shown in FIG. 2A), the front vertical wall 20 also includes a magnetic component 98 for interacting with the magnetic component 86 of the third end panel 50 to form a complementary connection means, such as a magnet-magnet or magnet-ferrous material connection. In some embodiments, the magnetic component 98 is secured to the front vertical wall 20 using an adhesive sheet or label (not shown). Regardless, as the third end panel 50 is brought in closer proximity to the front vertical wall 20, the magnetic components 86, 98 optionally interact with each other and draw the third end panel 50 toward the front vertical wall 20. When the third end panel 50 is flush against the front vertical wall 20, the third end panel 50 is maintained in an upright position and acts as a support to maintain the cover 14 (and the box 10) in the display position. Although FIG. 5A depicts the magnetic component 98 within the front vertical wall 20 as being a single rectangular piece that stretches the length of the front vertical wall 20, the magnetic component 98 is optionally any shape and includes any number of pieces. In addition, although FIG. 5A depicts the front vertical wall 20 and the third end panel 50 as including complementary magnetic components 86, 98, any connection components are optionally used to maintain the third end panel 50 to the front vertical wall 20. For example, the third end panel 50 is held against the front vertical wall 20 by connection means including, but not limited to: hook and loop fasteners such as those sold under the tradename Velcro®; a tab-and-slot mechanism; a releasable adhesive; a clip; slots; frictional engagement; or a resilient but deformable hinging.

As can be seen in FIG. 5, the second intermediate panel 48 is configured to function as a display platform for the product 16 when the first attachment and second intermediate panels 46, 48 form the inverted V-shape. In addition, because the third end panel 50 is substantially the same size as the front vertical wall 20, the third end panel 50 fits behind the front vertical wall 20 and cannot be seen by a viewer situated in front of the front vertical wall 20. When the box 10 is in the display position, the box 10 provides an aesthetically pleasing method of showing or exhibiting the product 16. This is particularly beneficial in a retail environment. To further increase the aesthetic appearance of the box 10 in the display position and to prevent detracting attention away from the product 16 being displayed, the free end 92*a* of the tab 92 is optionally pulled over the top edge 30 of the front vertical wall 20 and underneath the second edge 70 of the third end panel 50 and into the base 12 so that the tab 92 functions as a decorative feature of the display box 10.

To return the box 10 to the open (FIG. 3) or storage (FIG. 2) positions, the attachment panel 46 and the intermediate panel 48 are either individually moved back into the desired position or are simultaneously moved back into the desired position. In other words, the attachment panel 46 and the intermediate panel 48 are either maintained in a separated configuration and moved into the desired position in a series of motions or are folded such that the bottom surface 58 of the attachment panel 46 and the bottom surface 66 of the intermediate panel 48 are flush with one another and moved into the desired position in one motion.

A plurality of boxes 10 in the storage, open and display positions are optionally displayed in a retail environment to allow consumers to view the boxes 10 in their various functional positions. In these positions, the consumers are also able to view the product 16.

FIGS. 6-11 depict rear, left side, right side, top and bottom views, respectively, of an ornamental appearance of the box 10, according to some embodiments.

The storage and display box of the present invention is positionable in a storage position, an open position and a display position. The box thus allows a user to store, remove and display a product. The box includes an open top base and a cover hingedly attached to the base. The cover is divided into three sections, an attachment section attached to the base, an intermediate section attached to the attachment section, and an end section attached to the intermediate section. When the box is in the storage position, the intermediate section is folded against the attachment section to cover the base and the end section is positioned within the base. When the box is in the open position, the intermediate section and the attachment section are pulled away from the base. When the box is in the display position, the attachment section and the intermediate section form an inverted V-shape. The end section is positioned within the base and supports the attachment and intermediate sections. A product is positionable on the intermediate section for storage and display.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A container comprising:

a housing having at least a first vertical wall and a second vertical wall facing the first vertical wall defining an open top and the housing having a bottom panel; and a lid attached to the housing including:

a first panel having a first edge and a second edge, wherein the first edge of the first panel is attached to the first vertical wall of the housing at a first hinge;

a second panel having a first edge and a second edge, wherein the first edge of the second panel is attached to the second edge of the first panel at a second hinge; and a third panel having a first edge and a second edge, wherein the first edge of the third panel is attached to the second edge of the second panel at a third hinge, wherein the lid is positionable in a closed position and a display position, wherein the second edge of the third panel is supported on the bottom panel of the housing to maintain the lid in the display position, wherein the lid covers the open top of the housing and the first hinge and the third hinge form a virtual hinge when the lid is in the closed position, and wherein when the lid is in the display position, the lid forms an inverted V-shape extending from a top edge of the first vertical wall to a top edge of the second vertical wall over the open top such that the second panel forms a display platform.

2. The container of claim 1, wherein the third panel is releasably secured to the housing.

3. The container of claim 2, wherein the third panel is releasably secured to the housing by a magnetic connection.

4. The container of claim 1, wherein the housing includes a front wall having a magnetic component, and wherein the third panel includes a magnetic component for interacting with the magnetic component of the front wall of the housing.

5. The container of claim 4, wherein the third panel is substantially parallel to and abuts the front wall of the housing when the lid is in the display position.

6. The container of claim 1, and further comprising means for securing the lid in the closed position.

7. The container of claim 1, and further comprising means for securing the lid in the display position.

8. The container of claim 1, wherein the display position is characterized by the second panel being tilted back relative to the first panel to define a display surface for maintaining a retail product.

9. A box for storing and displaying a small article, the box comprising:

a base having a bottom panel, a first substantially vertical wall, a substantially second vertical wall opposite the first substantially vertical wall, a third substantially vertical wall and a fourth substantially vertical wall opposite the third substantially vertical wall, wherein the substantially vertical walls extend substantially perpendicularly from the bottom panel; and a cover attached to one of the substantially vertical walls of the base, wherein the cover comprises:

a front portion attached to the second substantially vertical wall of the base at a first hinge;

a rear portion attached to the front portion at a second hinge; and a flap attached to the rear portion at a third hinge, wherein an edge of the flap is supported on the bottom panel of the base to maintain the cover in a display position relative to the base with the front portion and the rear portion extending from a top edge of the second substantially vertical wall to a top edge of the first substantially vertical wall;

wherein each of the first substantially vertical wall of the base and the flap includes a magnetic component; and wherein the magnetic components of the first substantially vertical wall and the flap interact to maintain the cover in the display position; wherein the front portion and the rear portion form an inverted V-shape when the cover is in the display position.

10. The box of claim 9, wherein the flap is positioned substantially parallel to and abuts the first substantially vertical wall of the base when the cover is in the display position.

11. The box of claim 9, wherein the cover is positionable in a closed position over the base.

12. The box of claim 11, and further comprising means for securing the cover in the closed position.

13. The box of claim 11, wherein the flap is positioned substantially parallel to and abuts the second substantially vertical wall of the base when the cover is in the closed position.

14. The box of claim 9, wherein the rear panel includes at least one attachment feature for maintaining the small article on the rear portion when the cover is in the display position.

15. A method of displaying a product comprising:

pivoting a cover of an open top box about a hinge away from a front wall of the open top box and toward a back wall of the open top box, the cover having an attachment section, an intermediate section to which the product is secured, and an end section;

extending the intermediate section from the attachment section;

extending the end section from the intermediate section;

bending the intermediate section towards the attachment section such that a bottom surface of the intermediate section and a bottom surface of the attachment section form an acute angle;

positioning the end section parallel to the front wall of the box such that an edge of the end section is supported on a bottom wall of the open top box and such that a connection component of the end section interacts with a complementary connection component of the front wall to maintain the bottom surfaces of the attachment section and the intermediate section at an acute angle relative to one another and extend the attachment section and the intermediate section from a top of the front wall to a top of the back wall; and displaying the product on the intermediate section to a viewer.

16. The method of claim 15, wherein the connection components are magnetic components.

17. The method of claim 15, wherein bending the intermediate section comprises forming an inverted V-shape with the intermediate section and the attachment section.

18. The method of claim 15, wherein the connection components maintain the cover in a display position.

19. The method of claim 15, and further comprising positioning the product on the intermediate component and pivoting the cover of the open top box to a closed position over the open top box.

20. A display platform comprising:

a structure having a base piece, first side piece, a second side piece, a third side piece and a fourth side piece, wherein the side pieces are attached to the base piece;

a top attached to one of the side pieces of the structure, wherein the top comprises:

an attachment segment attached to one of the side pieces;

an intermediate segment attached to the attachment segment at a first hinge; and an end segment attached to the intermediate segment at a second hinge, wherein an edge of the end segment is supported on the base piece of the structure to maintain the cover in a display position with the attachment segment and the intermediate segment extending from a top edge of the one of the side pieces of the structure to a top edge of a facing one of the side pieces of the structure, and wherein the end segment is substantially equal in size to the side pieces; and means for maintaining the display platform in the display position;

wherein the attachment segment and the intermediate segment form an inverted V-shape when the top is in the display position.

21. The display platform of claim 20, wherein the means for maintaining the display platform comprises corresponding connection elements in the first side piece and the end segment.

22. The display platform of claim 20, wherein the means for maintaining the display platform comprises a first magnetic component positioned within the first side piece and a second magnetic component positioned within the end segment.

* * * * *